United States Patent [19]

Garron

[11] 4,232,617

[45] Nov. 11, 1980

[54] ONE-STEP BUTTONHOLER WITH HALL EFFECT SENSOR

[75] Inventor: Stephen A. Garron, Elizabeth, N.J.

[73] Assignee: The Singer Company, Stamford, Conn.

[21] Appl. No.: 30,503

[22] Filed: Apr. 16, 1979

[51] Int. Cl.[3] ..... D05B 3/06; D05B 3/02

[52] U.S. Cl. ..... 112/158 B; 112/158 E

[58] Field of Search ..... 112/158 B, 158 E, 65, 112/264, 77, 235

[56] References Cited

U.S. PATENT DOCUMENTS

| | | | |
|---|---|---|---|
| 3,113,537 | 12/1963 | Bono | 112/158 B |
| 3,656,443 | 4/1972 | Ross | 112/158 B X |
| 4,056,070 | 11/1977 | Hauf | 112/158 B |
| 4,161,150 | 7/1979 | Brown | 112/158 E |

FOREIGN PATENT DOCUMENTS

| | | | |
|---|---|---|---|
| 596489 | 7/1959 | Italy | 112/158 B |

*Primary Examiner*—Peter P. Nerbun

*Attorney, Agent, or Firm*—Edward P. Schmidt; Robert E. Smith; Edward L. Bell

[57] ABSTRACT

A sewing machine is disclosed having means for automatically sewing a buttonhole. A Hall Effect sensor switch interacts with a lever, which engages adjustable spots on a buttonhole gaging presser foot, to provide signals for electronic circuit logic indicating the end of a buttonhole being sewn.

4 Claims, 11 Drawing Figures

ONE-STEP BUTTONHOLER WITH HALL EFFECT SENSOR

DESCRIPTION

BACKGROUND OF THE INVENTION

This invention relates to zig zag sewing machines, and in particular, zig zag sewing machines capable of automatically producing buttonholes of various sizes.

There are many different types of automatic buttonhole mechanisms on sewing machines. With the increasing use of electrical devices for controlling, or actuating, the sewing machine stitch forming instrumentalities, electrical switches are replacing mechanical linkages for effecting different state changes in the various operating mechanisms, as, for example, the buttonhole mechanism. The use of electrical switches, however, fosters a new, or more acute, problem area. The environment in which a sewing machine operates contains a high degree of contaminates in the form of lint particles. These particles are dielectric in nature and tend to collect on the switch contacts causing spotty electrical operation or complete failure of the switches.

U.S. Pat. No. 3,113,537 of Bona discloses one embodiment of a buttonhole mechanism in which the control mechanism therefor employs the breaking of a light beam to a photoelectric sensor to achieve a switching. While this arrangement may eliminate electrical failure to contact contamination, it nevertheless is susceptible to contaminant failure when the light is impeded from impinging the sensor due to a layer of contaminants.

SUMMARY OF THE INVENTION

An object of this invention is to provide a control means for a sewing machine buttonhole device which is insensitive to contamination.

Another object of this invention is to provide a control means which is not susceptible to through wear.

These objects are achieved in a zig zag sewing machine having electronic logic circuitry for controlling the stitch forming instrumentalities and for storing various stitch patterns including a buttonhole pattern, a downwardly biased presser bar, a buttonhole engaging presser foot pivotally mounted to the end of the pressor bar which includes a shiftable shoe, and magnetic indicating means cooperating with the presser foot for indicating the said electronic logic circuitry the size of a desired buttonhole.

DESCRIPTION OF THE DRAWINGS

With the above and additional objects and advantages in mind as will hereinafter appear, the invention will be described with reference to the attached drawings in which.

DESCRIPTION OF THE PREFERRED EMBODIMENT

Figure 1:
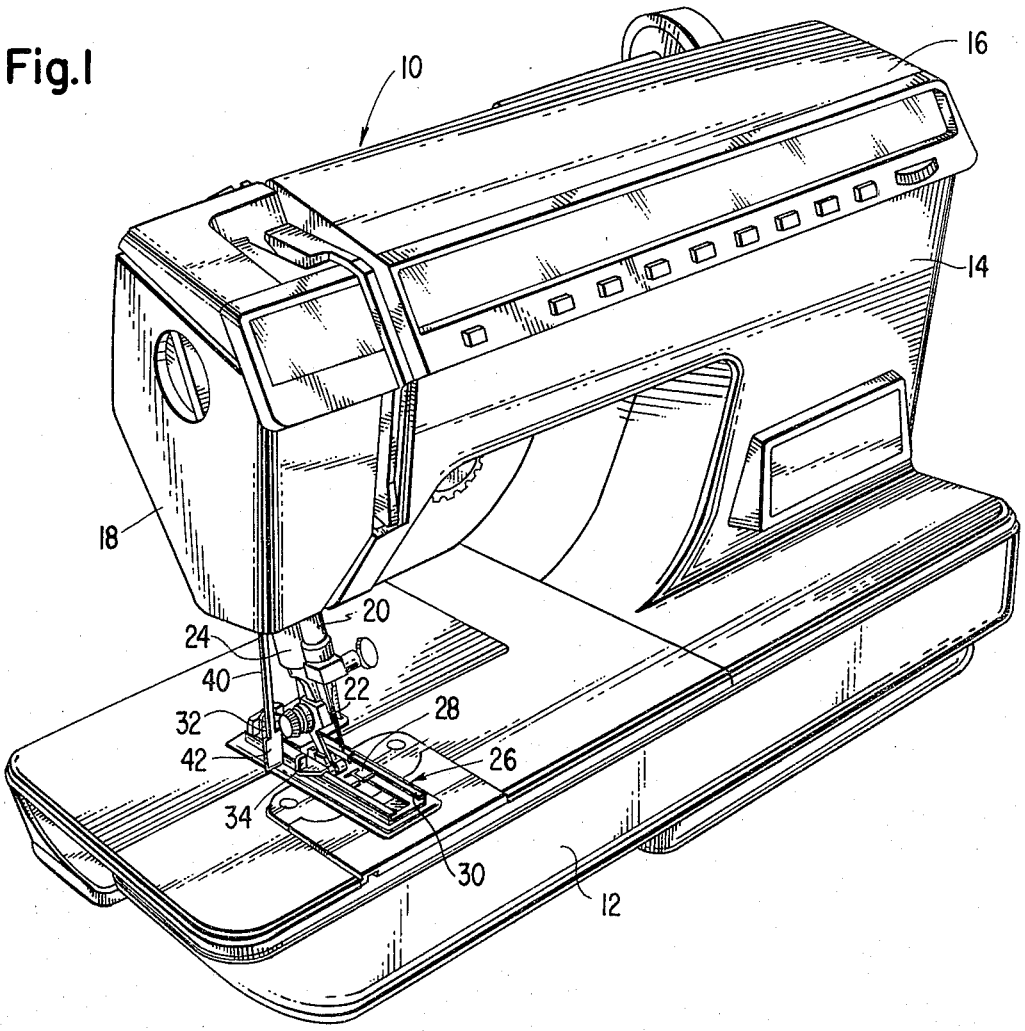
FIG. 1 is front perspective view of a sewing machine.
Figure 2A:
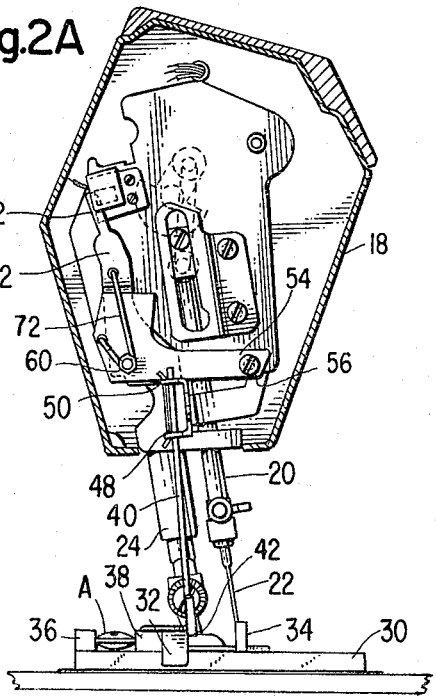
FIG. 2A is a left side elevational view of the sewing machine of FIG. 1, partly in section, showing the invention signaling the first end of a buttonhole.
Figure 2B:
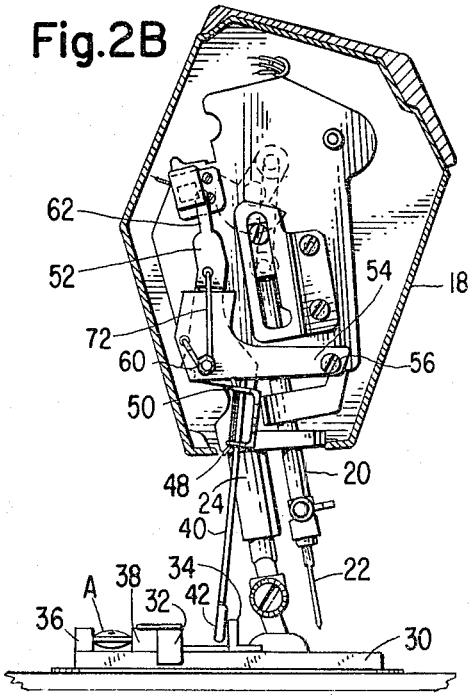
FIG. 2B is a left side elevational view of the sewing machine as in FIG. 2A showing the invention signaling the second end of a buttonhole.

In FIG. 1, a sewing machine 10 is shown having a bed 12, a hollow standard 14 rising vertically from the bed 12 and a bracket arm 16 extending horizontally from the standard 14 and overhanging the bed 12. The bracket arm 16 terminates in a sewing head 18 which has journaled therein a reciprocatory needle bar 20, having a sewing needle 22 removably attached to the lower end thereof, which is also arranged for laterally jogging motion in the fabrication of zigzag stitches. A downwardly biased presser bar 24 is also carried within the sewing head 18 and together with a buttonhole presser attachment 26, removably attached to the lower end thereof, urges the material being sewn into engagement with a feed mechanism (not shown) for incrementally advancing the material being sewn in the fabrication of stitches. The buttonhole pressor attachment 26, which is disclosed in the U.S. Pat. No. 3,877,403 of Ketterer hereby incorporated by reference, includes a presser foot 28 pivotally mounted to the presser bar 24 and a shoe 30 slidably mounted to the pressor foot 28 for movement in the direction of material feed along with the material being sewn. As shown in FIGS. 2A and 2B, the shoe 30 has mounted thereon a fixed rear stop member 32 and an adjustable front stop member 34, the distance therebetween defining the length of the buttonhole being sewn, as determined by the size of a button A inserted between an anchor element 36 and a buttonhole gaging element 38.

Figure 3:
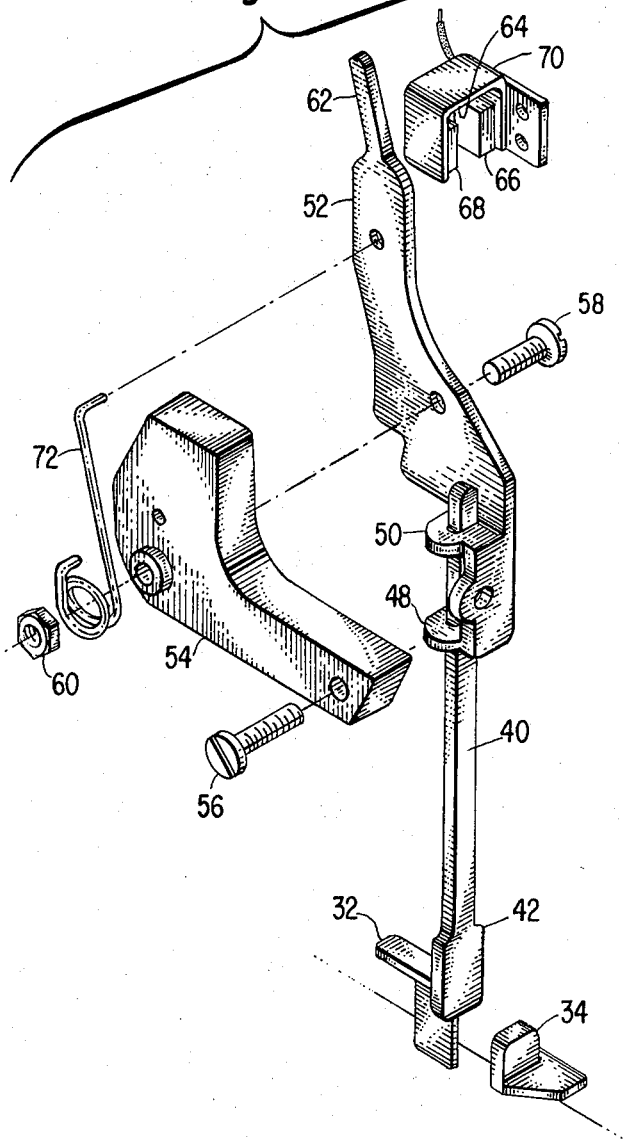
FIG. 3 is an exploded perspective view of the invention along with the control lever therefor.
Figure 5A:
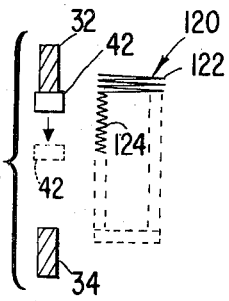
FIGS. 5A, 5B and 5C show the sequence of positions for the lower portion of the control linkage in cooperation with stops on a buttonhole foot during the fabrication of a buttonhole.
Figure 5B:
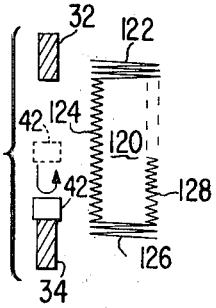

Referring to FIGS. 2A, 2B and 3, the sewing machine 10 further includes a switch mechanism including a lever arm 40 terminating in a paddle 42 at the lower end thereof. The opposite end of the lever arm 40 is received by openings formed respectively in a pair of spaced lugs 48 and 50 formed at one end of a lever 52. The lever arm 40 may therefore be selectively raised or lowered by an operator. When in use, the lever arm 40 may be lowered to a position in which the paddle 42 is intermediate the stop members 32 and 34 on the buttonhole pressor attachment 26. A bracket 54, anchored to sewing machine 10 by a screw 56, is provided to which the lever 52 is pivotally mounted using a screw 58 and a matching nut 60. The end of the lever 52 opposite from the lugs 48 and 50 takes the form of a wand 62 and is arranged to move through a gap 64 between a Hall Effect sensor 66 and a permanent magnet 68 as mounted on a U-shaped bracket 70 also mounted within the sewing machine 10 sewing head 18. A spring 72 is further provided for biasing the lever 52 such that the wand 62 thereof assumes a position midway the gap 64.

Figure 6:
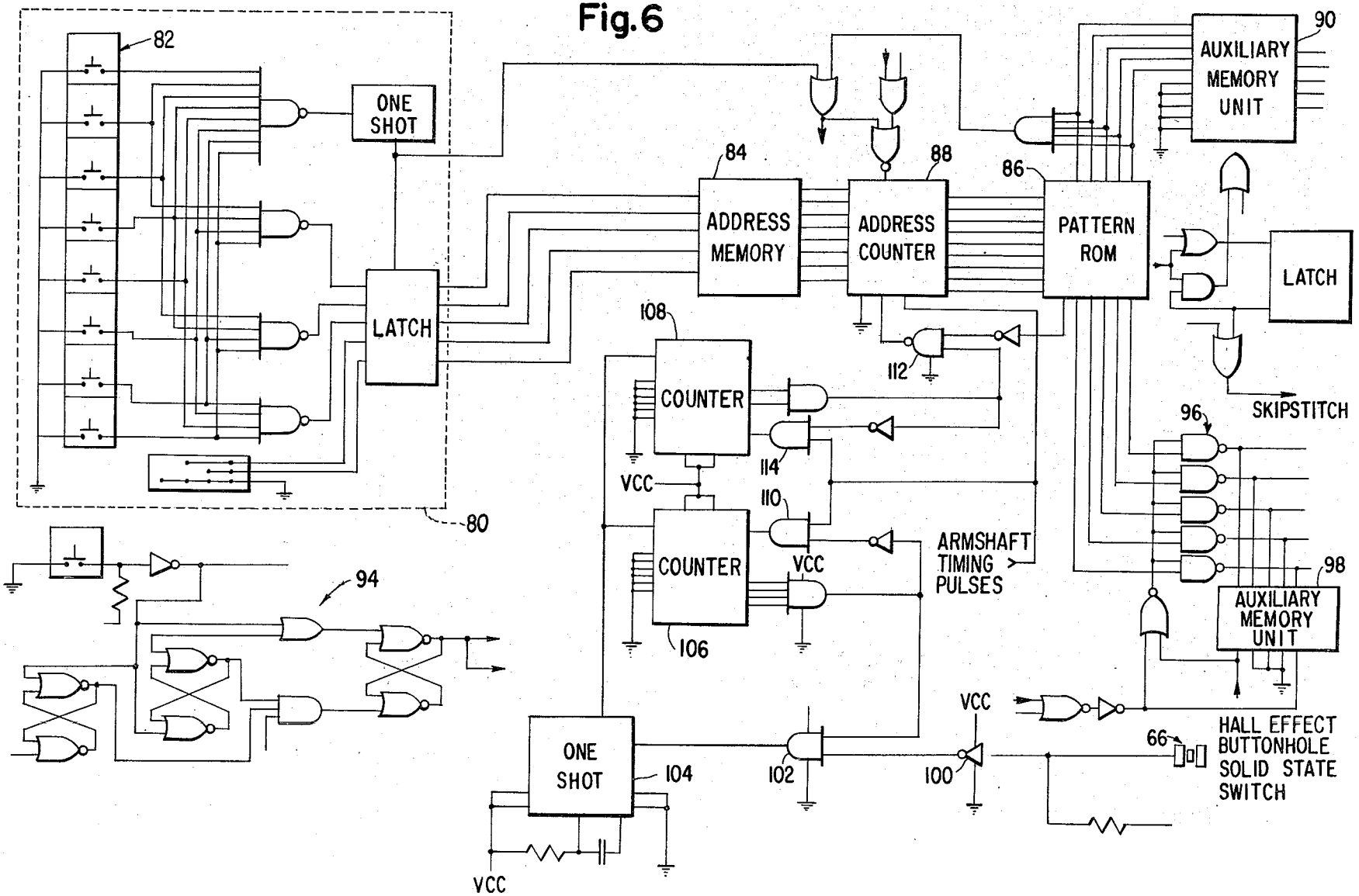
FIG. 6 is a schematic diagram showing additions to the sewing machine logic circuitry needed for the incorporation of the invention.

In FIG. 6 there is shown a schematic diagram depicting electronic logic circuitry with which the Hall Effect sensor 66 cooperates for controlling the stitch forming instrumentality. The logic circuitry is substantially the same as that disclosed in U.S. Pat. No. 3,987,739 of Wurst, et al which is hereby incorporated by reference. In general, the logic circuitry includes a pattern selection means 80 having a set of switches 82 therein. The pattern selection means 80 is coupled to an address memory 84 which continuously defines the starting word address of a group of consecutive word addresses in a pattern ROM 86. An address counter 88 is found intermediate the address memory 84 and the pattern ROM 86 and is responsive to arm shaft timing pulses to consecutively increase the address on the input lines on the pattern ROM 86. With respect to bight output signals, the output from the pattern ROM 86 is directed to an auxiliary memory 90 which stores one pattern of stitch bight information corresponding, for example, to center needle position, and applies this information to the output thereof in response to a signal from a skip stitch circuit (not shown) and a single pattern machine inhibit circuit 94 as described in detail in the U.S. Pat. No. 3,987,739. The feed output from the pattern ROM 86 is directed to a series of NAND gates 96, the output from which may be influenced by a second auxiliary memory 98. The second auxiliary memory 98 provides feed control signals corresponding to zero feed after the stitching of each single pattern has been completed when the single pattern control is effective.

A circuit for coupling the output of the Hall Effect sensor 66 is shown in FIG. 6. The sensor 66 is coupled to an operational amplifier 100 which outputs to one of the inputs of an AND gate 102 which, in turn, is coupled to a one shot multivibrator 104. The one shot 104 provides reset information to a first counter 106 and a second counter 108. The first counter 106 is coupled with a second input of the AND gate 102 and causes the circuit to ignore any subsequent signals from the Hall Effect sensor 66 for sixteen stitches as determined by arm shaft timing pulses entering the first counter 106 through an AND 110. The second counter 108 outputs to one input of a NAND 112, which is coupled to the address counter 88, and causes the address counter 88 to ignore feed signals from the pattern ROM 86 for four stitches as determined by arm shaft timing pulses entering the second counter 108 through an AND gate 114. The first counter 106 precludes erroneous signals from triggering the circuitry due to the wand 62 on the lever 52 returning to the neutral position thereof after initial reflection. The second counter 108 prevents material feed such that the sewing machine 10 may form a bar tack at each end of the buttonhole.

Figure 4A:
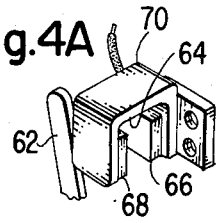
FIG. 4A, 4B and 4C show the sequence of positions for the control linkage through the Hall Effect sensor switch in the sewing of a buttonhole.
Figure 4B:
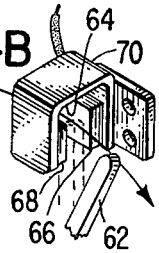
Figure 4C:
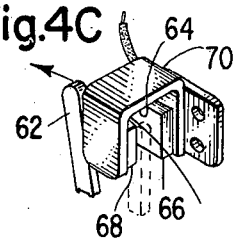
Figure 5C:
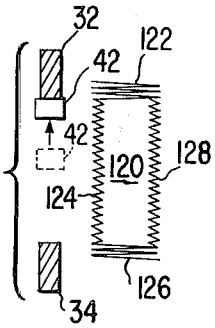

FIGS. 4A, 4B, 4C and 5A, 5B, 5C illustrate the sequence of operation of the lever 52 wand 62 in relation to the Hall Effect sensor 66 and the paddle 42 of the lever arm 40 in relation to the stop members 32 and 34 with the various phases of fabricating a buttonhole 120. Initially, the operator installs the buttonhole presser attachment 26 (FIG. 1, 2A & 2B) to the presser bar 24 and then lowers the lever arm 40 until the paddle 42 is intermediate the stop members 32 and 34. The shoe 30 of the attachment 26 is then positioned such that the stop member 32 engages the paddle 42 corresponding to the positions depicted in FIGS. 4A and 5A. At this point when the buttonholing pattern is selected, a signal is sent by the Hall Effect sensor 66 resetting the first and second counter 106 and 108. Thusly, the sewing machine 10 sews a first bar tack 122 and commences sewing one leg 124 of the buttonhole 120. The movement of the material as the buttonhole leg 124 is being sewn carries with it the shiftable shoe 30 which moves the stop member 32 allowing the lever arm 40 to assume the neutral position therof, under the influence of the spring 72, wherein the lever 52 wand 62 is midway the gap 64. As the leg 124 of the buttonhole 120 being sewn approaches the desired length the stop member 34 oppositely engages the paddle 42 causing the lever 52 wand 62 to move oppositely out of the gap 64 causing a signal to be sent to the logic circuitry suspending feed such that the second bar tack **12*b* of the buttonhole may be sewn (see FIGS. 4B and 5B). The sewing machine 10 then proceeds to sew the second leg 128 of the buttonhole 120 and in so doing moves the stop member 34 allowing the lever arm 40 to again assume the neutral position thereof. Referring to FIGS. 4C and 5C, when the sewing machine 10 completes the second leg 128 of the buttonhole 120, the stop member 32 again engages the paddle 42 causing the lever 52 wand 62 to leave the gap 64 as in FIG. 4A, indicating to the logic circuitry the end of the buttonhole 120**.

An added benefit in using the invention is seen through an increase in reliability as well as a reduction in cost. In general, a standard electrical switch in place of the Hall Effect sensor 66 would require at least two connections to the electronic logic circuitry, which may be in the form of an LSI chip. By using the Hall Effect sensor, only one connection is required, reducing manufacturing cost of the LSI chip while inherently increasing the reliability of the arrangement.

Numerous alterations of the structure herein disclosed will suggest themselves to those skilled in the art. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

I claim:

1. In a zigzag sewing machine having stitch forming instrumentalitites including a reversible incremental feed mechanism and a reciprocatory needle bar arranged for lateral jogging motion, electro-magnetic actuation means for controlling various of the stitch forming instrumentalities and electronic logic circuitry for the activation of said actuation means and for the storing of various stitch patterns inclusive of a buttonhole pattern, means for determining the size of a buttonhole being sewn comprising:

a downwardly biased presser bar;

a buttonhole gauging presser foot pivotally mounted to the end of said presser bar, said presser foot including a shoe shiftably mounted thereto for movement in the direction of material feed; and magnetic indicating means cooperating with said presser foot for indicating to said electronic logic circuitry the size of the desired buttonhole.

2. The means for determining the size of a buttonhole as set forth in claim 1 wherein said magnetic indicating means comprises a Hall Effect sensor switch.

3. The means for determining the size of a buttonhole as set forth in claim 2 wherein said buttonhole gauging presser foot further includes a pair of button receiving elements for holding a button of the desired size therebetween.

4. The means for determining the size of a buttonhole as set forth in claim 3 wherein said buttonhole gauging presser foot further includes stop means adjustably positioned by said button receiving elements and said sewing machine further includes a lever overhanging said presser foot for engaging said stop means, said lever being arranged to pass through said Hall Effect sensor switch when said lever engages said stop means.

* * * * *